US005260760A

United States Patent [19]

Takemura et al.

[11] Patent Number: 5,260,760

[45] Date of Patent: Nov. 9, 1993

[54] IMAGE FORMING APPARATUS WITH AUXILIARY IMAGE FORMING MECHANISM

[75] Inventors: Osamu Takemura, Nishinomiya; Eiji Nimura, Tondabayashi, both of Japan

[73] Assignee: Mita Industrial Co., Ltd., Osaka, Japan

[21] Appl. No.: 796,666

[22] Filed: Nov. 25, 1991

[30] Foreign Application Priority Data

| | | | |
|---|---|---|---|
| Nov. 27, 1990 | [JP] | Japan | 2-326422 |
| Nov. 27, 1990 | [JP] | Japan | 2-326423 |
| Nov. 29, 1990 | [JP] | Japan | 2-335266 |
| Nov. 29, 1990 | [JP] | Japan | 2-335267 |
| Nov. 29, 1990 | [JP] | Japan | 2-335268 |

[51] Int. Cl.[5] ..... G03G 15/01

[52] U.S. Cl. ..... 355/328; 346/154; 355/245

[58] Field of Search ..... 355/245, 246, 271, 202, 355/328; 346/154, 155, 159

[56] References Cited

U.S. PATENT DOCUMENTS

| | | | |
|---|---|---|---|
| 4,640,601 | 2/1987 | Deguchi et al. | 355/200 |
| 4,810,604 | 3/1989 | Schmidlen | 430/42 |
| 5,097,296 | 3/1992 | Goto et al. | 355/328 |
| 5,128,695 | 7/1992 | Maeda | 346/154 X |

OTHER PUBLICATIONS

Xerox Disclosure Journal, vol. 11, No. 2, (Mar. 1986).

European Search Report for EPO Application 91310886.6.

*Primary Examiner*—Leo P. Picard

*Assistant Examiner*—Christopher Horgan

*Attorney, Agent, or Firm*—Renner, Otto, Boisselle & Sklar

[57] ABSTRACT

The present invention relates to an image forming apparatus comprising a main image forming mechanism for forming a toner image on a recording sheet based on image information and an auxiliary image forming mechanism for forming an auxiliary image on a recording sheet on which the main image is formed. The auxiliary image forming mechanism supplies charged toner to a substrate provided with a plurality of toner passage holes and selectively forms electric potential which allow or does not allow the charged toner to pass through each toner passage hole by a pair of electrodes. A predetermined image is formed with the toner passed through the toner passage holes.

13 Claims, 5 Drawing Sheets

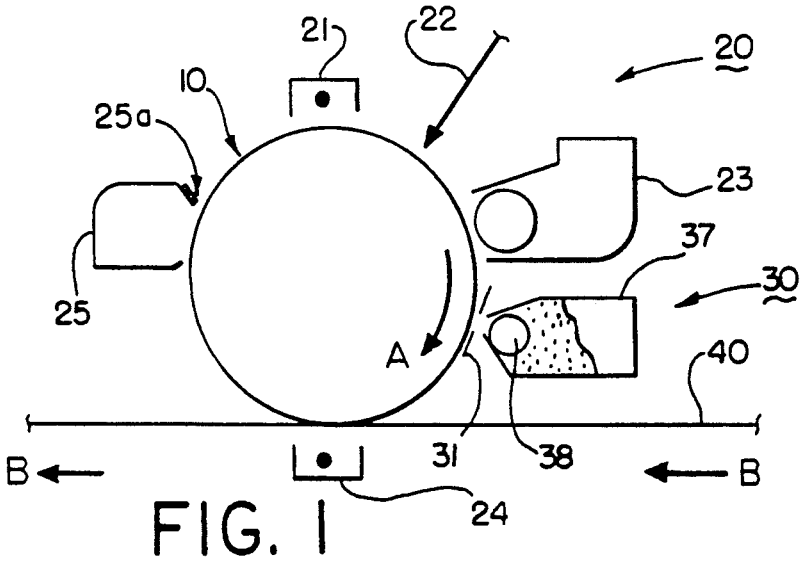
FIG. 1
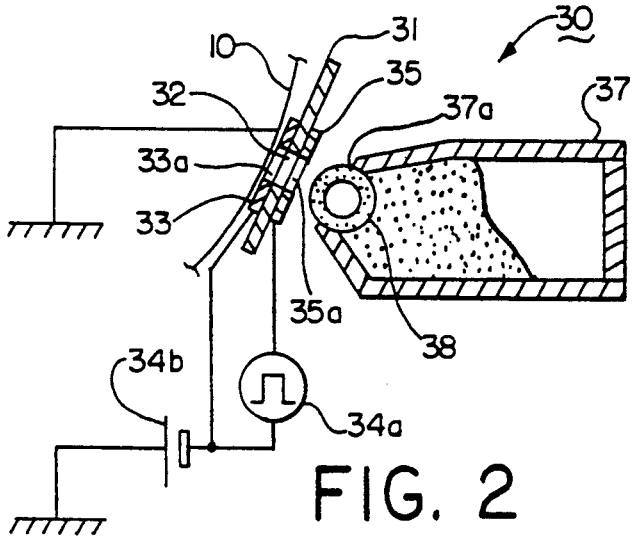
FIG. 2
FIG. 3
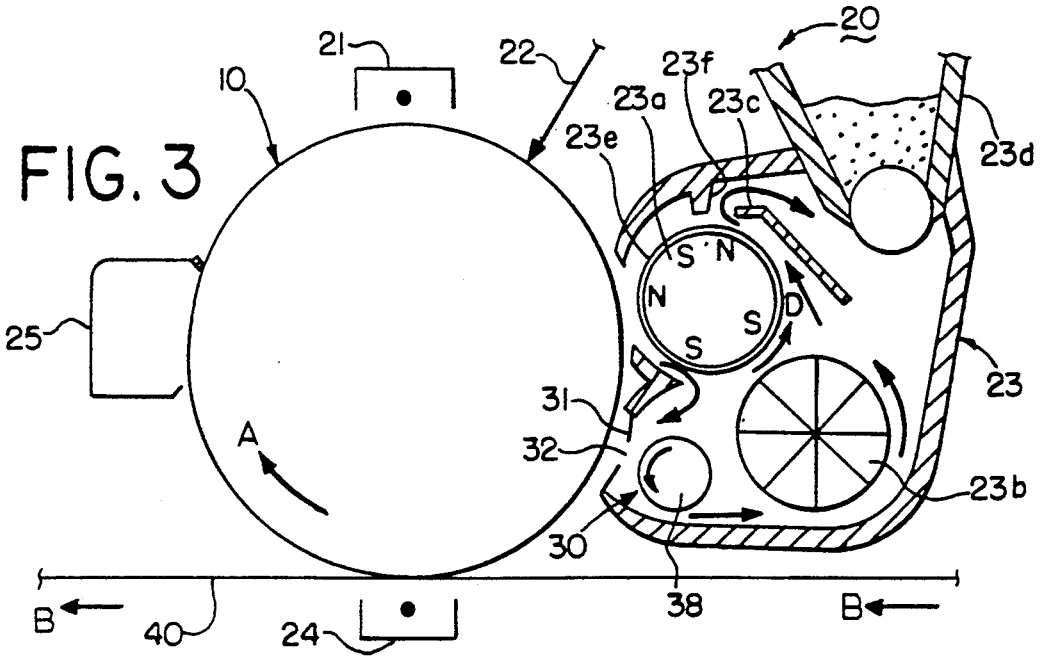

IMAGE FORMING APPARATUS WITH AUXILIARY IMAGE FORMING MECHANISM

BACKGROUND OF THE INVENTION

1. Field of the Invention

The present invention relates to an image forming apparatus for forming an auxiliary image such as dates and marks on a recording sheet on which a main image such as a duplicate image of an original and an image based on an image information signal has been formed.

2. Description of the Prior Art

In recent years, an image forming apparatus for forming an auxiliary image such as dates and marks on a recording sheet on which a main image such as a duplicate image of an original and an image based on an image information is previously formed has been developed. In this kind of image forming apparatus, generally, a main image is formed on a recording sheet by a main image forming mechanism which uses an electrophotographic process, and then an auxiliary image such as dates and marks is formed on the recording sheet by an auxiliary image forming mechanism of a thermal transfer recording. The auxiliary image forming mechanism is disposed on the downstream side in the direction of the recording sheet transported by a fixing roller for fixing the main image formed by the main image forming mechanism on the recording sheet and generally includes a printer head of a thermal transfer recording and an ink ribbon. After the main image is fixed on the recording sheet, the auxiliary image is formed on the recording sheet by the auxiliary image forming mechanism of a thermal transfer recording.

Since the above-mentioned image forming apparatus includes the auxiliary image forming mechanism of a thermal transfer recording. an ink ribbon is required. Moreover, the printing speed is low, so that the transportation speed of the recording sheet which has passed the fixing roller should be lowered. Furthermore, the fixing roller is disposed on the downstream side of the direction of the recording sheet transported by the fixing roller, so that a distance between the fixing roller and an exit for the recording sheet should be made long, resulting in a large size of the apparatus.

SUMMARY OF THE INVENTION

The present invention overcomes the above-discussed and numerous other disadvantages and deficiencies of the prior art, and its objective is to provide an image forming apparatus in which an auxiliary image can be formed on a recording sheet together with a main image for a short period of time and which is not likely to be enlarged.

The image forming apparatus includes a main image forming mechanism for forming a main image on a recording sheet by transferring a toner image formed on a photosensitive body based on image information onto the recording sheet and an auxiliary image forming mechanism for forming an auxiliary image on the recording sheet, wherein the auxiliary image forming mechanism comprises:

a substrate having a plurality of toner passage holes;

a pair of electrodes which have through holes corresponding to the toner passage holes and which are disposed sandwiching the substrate in an insulated state so that each through hole is aligned with each toner passage hole;

toner supply means for supplying toner onto the electrode on one side; and image information generating means for applying predetermined potential between the pair of electrodes so that potential allowing the toner to pass through the toner passage holes in accordance with the image information is formed at least in the toner passage holes.

In a preferred embodiment, the auxiliary image forming mechanism forms the auxiliary image on the photosensitive body on which the toner image is formed by the main image forming mechanism.

In a preferred embodiment, the main image forming mechanism includes a developing unit for forming the toner image on the photosensitive image, and the auxiliary image forming mechanism is disposed adjacent to the developing unit.

In a preferred embodiment, the main image forming mechanism includes the developing unit for forming the toner image on the photosensitive body, and the auxiliary image forming mechanism is disposed in the developing unit.

In a preferred embodiment, the main image forming mechanism includes a cleaning unit for cleaning the photosensitive body after the toner image formed on the photosensitive body is transferred onto the recording sheet, and the toner removed from the photosensitive body by the cleaning unit is supplied to the auxiliary image forming mechanism.

In a preferred embodiment, the auxiliary image forming mechanism forms the auxiliary image on the recording sheet.

In a preferred embodiment, the auxiliary image forming mechanism is disposed facing the recording sheet transported into a position where the toner image formed on the photosensitive body is transferred.

In a preferred embodiment, the main image forming mechanism includes the developing unit for forming the toner image on the photosensitive body, and the auxiliary image forming mechanism is disposed in the developing unit.

In a preferred embodiment, the main image forming mechanism includes the developing unit for forming the toner image on the photosensitive body, the developing unit includes a toner accommodation means in which the toner is accommodated, and the auxiliary image forming mechanism is disposed in the toner accommodation means.

In a preferred embodiment, the auxiliary image forming mechanism is disposed facing the recording sheet transported with the toner image formed on the photosensitive body transferred thereon.

In a preferred embodiment, the main image forming mechanism includes a cleaning unit for cleaning the photosensitive body after the toner image formed on the photosensitive body is transferred onto the recording sheet, and the auxiliary image forming mechanism is disposed in the cleaning unit.

In a preferred embodiment, the auxiliary image forming mechanism forms the auxiliary image on the surface of the recording sheet which is opposite to the side of the surface on which the toner image formed on the photosensitive body is transferred.

In a preferred embodiment, the main image forming mechanism includes a transfer roller for transferring the toner image formed on the photosensitive body onto the recording sheet, and the auxiliary image forming mechanism forms the auxiliary image on the transfer roller.

In the image forming apparatus according to the present invention, the main image is formed on the recording sheet by the main image forming mechanism using the photosensitive body, and the auxiliary image is formed on the recording sheet by the auxiliary image forming mechanism. In the auxiliary image forming mechanism, toner supplied onto one electrode by the toner supply means is passed through the toner passage holes on the substrate by the image information generating means and forms the auxiliary image on the photosensitive body or the recording sheet on which the main image is formed. Before the toner image formed on the photosensitive body by the main image forming mechanism is transferred onto the recording sheet, the auxiliary image is formed on the photosensitive body by the auxiliary image forming mechanism. The main image and the auxiliary image are simultaneously transferred onto the recording sheet and fixed thereon, so that the image forming efficiency is remarkably improved.

In the auxiliary image forming mechanism, the auxiliary image is directly formed on the recording sheet before the toner image is transferred or on the recording sheet before the toner image is transferred to be fixed. Therefore, the main image and the auxiliary image can be fixed on the recording sheet at the same time, enabling improved image forming efficiency.

The auxiliary image forming mechanism is disposed in the developing unit in which the main image is developed with toner, and the auxiliary image is formed by using toner in the developing unit. Therefore, it is not required to provide a hopper for supplying toner used for forming the auxiliary image, and there is no possibility of enlarging the apparatus.

When toner removed from the photosensitive drum by the cleaning unit is supplied to the auxiliary image forming mechanism disposed in the developing unit, the unnecessary toner removed by the cleaning unit is used by the auxiliary image forming mechanism for forming the auxiliary image, whereby economical efficiency can be remarkably improved.

The auxiliary image forming mechanism is disposed in the cleaning unit for cleaning the photosensitive body used for forming the main image. The toner removed from the photosensitive body by the cleaning unit is used in the auxiliary image forming mechanism. Therefore, the apparatus is not likely to be enlarged and moreover, the economical efficiency can be remarkably improved.

The auxiliary image forming mechanism is adapted to form the auxiliary image on the opposite surface of that of the recording sheet on which the main image is formed. In this case, if the auxiliary image forming mechanism is adapted to form the auxiliary image on the transfer roller for transferring the main image onto the recording sheet, the auxiliary image can be efficiently formed on the recording sheet at the same time when the main image is transferred onto the recording sheet.

BRIEF DESCRIPTION OF THE DRAWINGS

This invention may be better understood and its numerous objects and advantages will become apparent to those skilled in the art by reference to the accompanying drawings as follows:

FIG. 1 is a schematic diagram showing a structure of the first example of an image forming apparatus according to the present invention.

FIG. 2 is a diagram showing enlarged main portions of the image forming apparatus shown in FIG. 1.

FIG. 3 is a schematic diagram showing a structure of the second example of the image forming apparatus according to the present invention.

DESCRIPTION OF THE PREFERRED EMBODIMENTS

Figure 4:
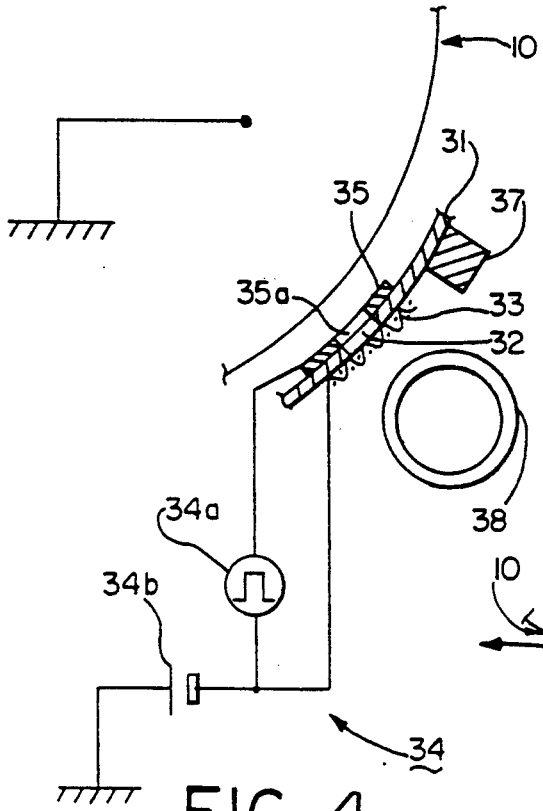
FIG. 4 is a diagram showing enlarged main portions of the image forming apparatus shown in FIG. 3.

The present invention will be described by way of illustrating examples with reference to the drawings below.

EXAMPLE 1

The first example of an image forming apparatus according to the present invention is shown in FIG. 1. This image forming apparatus comprises a known main image forming mechanism 20 having a photosensitive drum 10 which is grounded and an auxiliary image forming mechanism 30 which is disposed at the periphery of the photosensitive drum 10. The main image forming mechanism 20 is provided so as to form a main image such as a duplicate image of an original or an image based on an image forming information signal on a recording sheet 40. The auxiliary image forming mechanism 30 is provided so as to form an auxiliary image such as dates and marks on the recording sheet 40.

The main image forming mechanism 20 has a charger 21 for charging the photosensitive drum 10 which rotates in the direction of an arrow A. The charger 21 uniformly charges the photosensitive drum 10, for example, into a positive potential. The surface of the uniformly charged photosensitive drum 10 is exposed to light 22 from an optical system (not shown) to form a static latent image thereon, and then the static latent image is developed with negatively charged toner supplied from a developing unit 23. A toner image formed on the photosensitive drum 10 is transferred by a transfer unit 24 onto the recording sheet 40 transported in the direction of an arrow B. The recording sheet 40 on which the toner image is transferred is transported into a fixing unit (not shown), and the toner image is fixed onto the recording sheet by the fixing unit. Residual toner on the surface of the photosensitive drum 10 from which the toner image is transferred is removed by a blade 25*a* on a cleaning unit 25.

The auxiliary image forming mechanism 30 is disposed below the developing unit 23 at the periphery of the photosensitive drum 10. This auxiliary image forming mechanism 30 has an insulating substrate 31 provided facing the photosensitive drum 10 as shown in FIG. 2. In this insulating substrate 31, a plurality of toner passage holes 32 are aligned in parallel with the axial direction of the photosensitive drum 10.

On one surface of the insulating substrate 31 facing the photosensitive drum 10, a common electrode 33 is provided. In the respective common electrode 33, a plurality of through holes 33*a* having the same size as that of each toner passage hole 32 are provided. Each through hole 33*a* is formed so as to be aligned with each toner passage hole 32. The common electrode 33 is applied with a predetermined negative voltage by a bias power source 34*b*.

On the other surface of the insulating substrate 31, a plurality of signal electrodes 35 each having a through hole 35*a* having the same size as that of each toner passage hole 32 are provided so as to correspond to the respective passage holes 32. Each signal electrode 35 surrounds each toner passage hole 32 of the insulating substrate 31 so that they are adjusted to each other. The respective signal electrodes 35 provided at the respective toner passage holes 32 disposed adjacent to each other are electrically insulated from each other. The respective signal electrodes 35 are applied with a predetermined voltage based on the image information by an image information generating element 34*a*.

Each signal electrode 35 is provided with a toner container 37, and negatively charged toner is accommodated in the toner container 37. In the toner container 37, a toner supply roller 38 is provided facing each signal electrode 35, and the toner in the toner container 37 is supplied to each signal electrode 35 by the rotation of the toner supply roller 38.

In case that it is not required to form image information, each signal electrode 35 is applied with a higher voltage than that of the common electrode 33 by the image information generating element 34*a* which applies a predetermined negative voltage based on the image information to each signal electrode 35. In case that it is required to form image information, each signal electrode 35 is applied with a lower voltage than that of the common electrode 33 by the image information generating element 34*a*.

The operation of the above image forming apparatus will be described. In this image forming apparatus, the surface of the photosensitive drum 10 is charged into a positive potential by the charger 21 and is exposed to light 22 from the optical system (not shown). In a region on the surface of the photosensitive drum 10 which is exposed to light, charge disappears, so that a static latent image corresponding to the main image is formed with positive charge on the photosensitive drum 10. The static latent image formed on the photosensitive drum 10 is developed with negatively charged toner supplied from the developing unit 23, and a toner image corresponding to the main image information is formed on the photosensitive drum 10.

When the toner image corresponding to the main image information is formed on the surface of the photosensitive drum 10, the auxiliary image such as dates and marks is formed on the surface of the photosensitive drum 10 by the auxiliary image forming mechanism 30. When the charged region on the surface of the photosensitive drum 10 in which the auxiliary image is to be formed is positioned facing the auxiliary image forming mechanism 30, the image information generating element 34*a* applies to the predetermined signal electrodes 35 a lower voltage than that applied to the common electrode 33. Because of this, an electric field enabling the negatively charged toner to pass therethrough is formed in the predetermined toner passage holes 32 of the insulating substrate 31, and the negatively charged toner is passed through the predetermined toner passage holes 32. Then, the toner passed through the toner passage holes 32 is fixed onto the surface of the photosensitive drum 10 charged with a positive potential. Since the signal electrodes 35 which are not required to form an image are applied with a higher voltage than that of the common electrode 33 by the image information generating element 34*a*, an electric field through which the negatively charged toner is passed is not formed in the toner passage holes 32 corresponding to the signal electrodes 35 which are not required to form an image.

As described above, potential of a plurality of signal electrodes 35 is regulated on the basis of the image information generating element 34*a*, and a toner image corresponding to the auxiliary image together with a toner image corresponding to the main image information is formed on the surface of the photosensitive drum 10.

The respective toner images corresponding to the main image and the auxiliary image are transferred onto the recording sheet 40 by the transfer unit 24. The recording sheet 40 on which the main image and the auxiliary image are transferred is transported into the fixing unit (not shown), and then the respective images are fixed onto the recording sheet 40 by the fixing unit. Residual toner and the like on the photosensitive drum 10 from which the toner image is transferred are removed by the cleaning unit 25.

EXAMPLE 2

The second example of the present invention is shown in FIGS. 3 and 4. In this example, the auxiliary image forming mechanism 30 is provided in the developing unit 23 in the main image forming mechanism 20. The developing unit 23 comprises a developing sleeve 23*e* which is disposed facing the photosensitive drum 10 and rotated in the direction of an arrow D and a magnet 23*a* disposed in the developing sleeve 23*e*. The toner supply roller 38 in the auxiliary image forming mechanism 30 is disposed below the developing sleeve 23*e*. A stirring paddle 23*b* is disposed on the opposite side of the photosensitive drum 10 in the auxiliary image forming mechanism 30. A toner hopper 23*d* in which toner is accommodated is disposed above the stirring paddle 23*b*, and toner supplied from the toner hopper 23*d* is stirred with a developer by the stirring paddle 23*b* to be supplied to the developing sleeve 23*e*. The resulting developer is transported along the periphery of the developing sleeve 23*e* by the rotation thereof. The developer transported along the periphery of the developing sleeve 23*e* is regulated into a predetermined amount by a regulating member 23*f* disposed above the developing sleeve 23*e* and transported into a portion facing the photosensitive drum 10. Residual developer is returned to the stirring paddle 23*b* by a partition plate 23*c*.

The toner supply roller 38 of the auxiliary image forming mechanism 30 is provided below the developing sleeve 23*e*. As shown in FIG. 4, the auxiliary image forming mechanism 30 has the insulating substrate 31 formed between the toner supply roller 38 and the photosensitive drum 10. In this insulating substrate 31, a plurality of toner passage holes 32 are aligned in the axial direction of the photosensitive drum 10, and on the surface of the insulating substrate 31 facing the toner supply roller 38, a mesh-shaped common electrode 33 made of a conductive material is formed. Each mesh of the common electrode 33 is formed so as to allow only toner in the developer to pass therethrough without allowing carrier to pass therethrough. The common electrode 33 is applied with a predetermined negative voltage by the bias power source 34*b*.

On the surface of the insulating substrate 31 facing the photosensitive drum 10, a plurality of signal electrodes 35 each having the through holes 35*a* similar to the toner passage holes 32 are provided so as to correspond to each toner passage hole 32. Each signal electrode 35 surrounds each toner passage hole 32 of the insulating substrate 31, and each signal electrode 35 and each toner passage hole 32 are adjusted to each other. The respective signal electrodes surrounding each toner passage hole 32 adjacent to each other are not in contact with each other. Each signal electrode 35 is applied with a predetermined voltage by the image information generating element 34*a* based on the image information.

An ultrasonic vibrator 37 is provided on the insulating substrate 31, and ultrasonic vibration generated by the ultrasonic vibrator 37 is transmitted to the common electrode 33 through the insulating substrate 31. Because of this, toner can be efficiently passed through each mesh of the common electrode 33.

The toner in the developing unit 23 is supplied to the common electrode 33 on the insulating substrate 31 by the toner supply roller 38 disposed in the developing unit 23.

The signal electrodes 35 provided at the toner passage holes 32 which are not required to allow toner to pass through are applied with a lower voltage than that of the common electrode 33 by the image information generating element 34*a* which applies a predetermined negative voltage based on the image information to each signal electrode 35. The signal electrodes 35 provided at the toner passage holes 32 which are required to allow toner to pass through are applied with a higher voltage than that of the common electrode 33 by the image information generating element 34*a*.

In the above-mentioned image forming apparatus, when the toner image corresponding to the main image information is formed on the surface of the photosensitive drum 10, the auxiliary image such as dates and marks is formed on the photosensitive drum 10 by the auxiliary image forming mechanism disposed in the developing unit 23. When a charged portion on the surface of the photosensitive drum 10 in which the auxiliary image is to be formed is opposed to the insulating substrate 31 in the auxiliary image forming mechanism 30, the predetermined signal electrodes 35 are applied with a higher voltage than that applied to the common electrode 33 by the image information generating element 34*a*. Because of this, an electric field through which negatively charged toner is passed is formed in the predetermined toner passage holes 32 of the insulating substrate 31, and the negatively charged toner supplied from the toner supply roller 38 in the developing unit 23 is passed through the meshes of the common electrode 33 and the predetermined toner passage holes 32. Then, the toner passed through the toner passage holes 32 adheres to the surface of the photosensitive drum 10 which is charged into a positive potential. The image information generating element 34*a* applies a lower voltage than that of the common electrode 33 to the signal electrodes 35 provided at the toner passage holes 32 which are not required to allow toner to pass through. Therefore, an electric field through which the negative charged toner is passed is not formed in the toner passage holes 32 corresponding to these signal electrodes 35.

As described above, potential of the plurality of signal electrodes 35 is regulated based on the image information generating element 34*a*, and on the surface of the photosensitive drum 10, the toner image corresponding to the auxiliary image together with the toner image corresponding to the main image is formed.

The toner images respectively corresponding to the main image and the auxiliary image are transferred onto the recording sheet 40 by the transfer unit 24. The recording sheet 40 on which the main image and the auxiliary image are transferred is transported into the fixing unit (not shown), and the respective images are fixed on the recording sheet 40 by the fixing unit. Residual toner and the like on the photosensitive drum 10 from which the toner image is transferred are removed by the cleaning unit 25.

EXAMPLE 3

Figure 5:
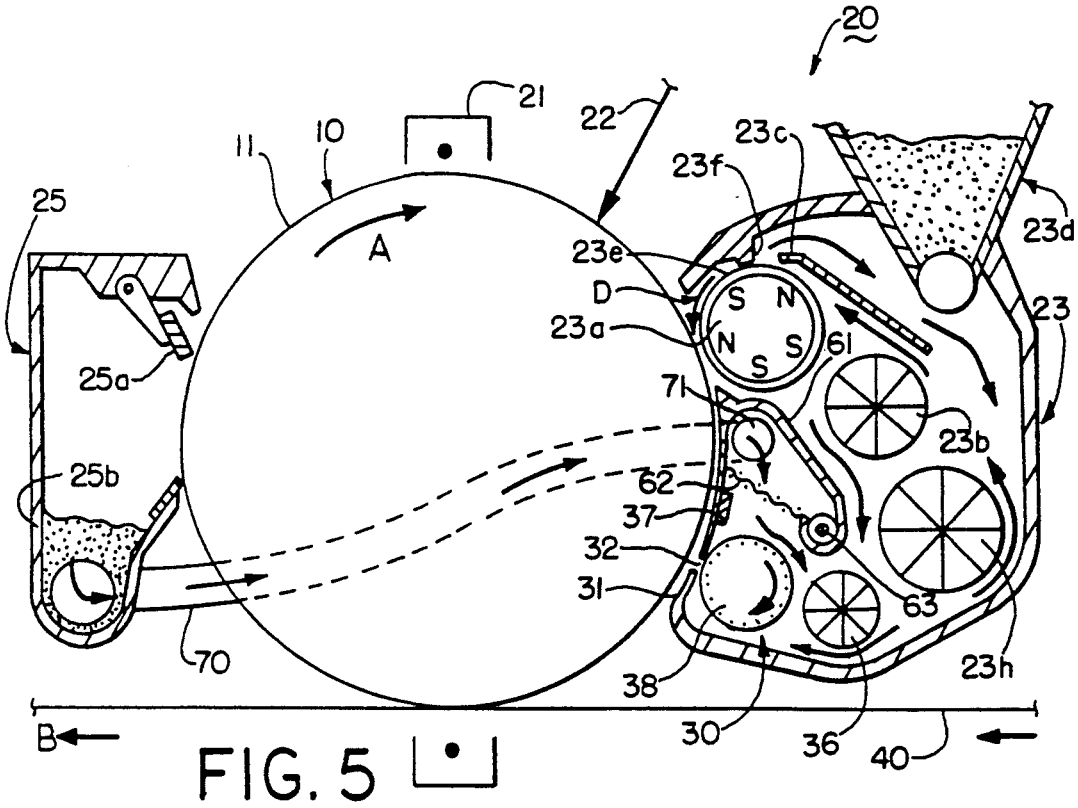
FIG. 5 is a schematic diagram showing a structure of the third example of the image forming apparatus according to the present invention.

The third example of the present invention is shown in FIG. 5. In this example, the auxiliary image forming mechanism 30 is disposed in the developing unit 23 in the same way as in the second example. Moreover, the toner removed from the photosensitive drum 10 by the cleaning unit 25 is adapted to be supplied to the auxiliary image forming mechanism 30.

The developing unit 23 comprises the developing sleeve 23*e* which is disposed facing the photosensitive drum 10 and is rotated in the direction of an arrow D and the magnet 23*a* provided in the developing sleeve 23*e*. The stirring paddle 23*b* is provided below the developing sleeve 23*e* on the opposite side of the photosensitive drum 10. The toner hopper 23*d* in which toner is accommodated is provided above the stirring paddle 23*b*. The toner supplied from the toner hopper 23*d* is stirred with developer by the stirring paddle 23*b* to be supplied to the developing sleeve 23*e*. The resulting developer is transported along the periphery of the developing sleeve 23*e* by the rotation thereof. The developer transported along the periphery of the developing sleeve 23*e* is regulated into a predetermined amount by the regulating member 23*f* disposed above the developing sleeve 23*e* and transported into the portion facing the photosensitive drum 10. Residual developer is returned to the stirring paddle 23*b* by the partition plate 23*c*.

The auxiliary image forming mechanism 30 is provided below the developing sleeve 23*e*. A region below the developing sleeve 23*e* is partitioned by a partition wall 61, and a terminal end of a spiral conveyer 70 into which toner and the like removed from the photosensitive drum 10 by the cleaning unit 25 transported is provided below the partition wall 61. A mesh member 62 for filtering off paper powder and the like from toner discharged from a toner exit 71 is disposed at an angle below the terminal end of the spiral conveyer so that one end of the mesh member 62 on the side of the photosensitive drum 10 is tilted upward. A spiral conveyer 63 is provided at the other end of the mesh member 62, and the paper powder and the like removed by the mesh member 62 are transported outside of the developing unit 23.

The toner supply roller 38 is provided below the mesh member 62. An auxiliary roller 36 is provided on the opposite side of the photosensitive drum 10 with respect to the toner supply roller 38. The toner flowing down along the partition wall 61 is transported into the toner supply roller 38 by the auxiliary roller 36. A draw-up roller **23*h* is provided on the opposite upper side of the toner supply roller 38 with respect to the auxiliary roller 36. The developer is drawn up to the stirring paddle 23*b* by the draw-up roller 23*h***.

The construction of the auxiliary image forming mechanism 30 is the same as that of the second example. Therefore, its description is omitted here. The vibration generated by the ultrasonic vibrator 37 provided in the auxiliary image forming mechanism 30 is transmitted to the mesh member 62, and because of this, the toner collected by the spiral conveyer 70 can be efficiently supplied to the toner supply roller 38.

Below the developing unit 23, there is a transportation path for the recording sheet 40 transported in the direction of an arrow B shown in FIG. 5. The transfer unit 24 for transferring an image onto the recording sheet transported along the transportation path is disposed below the photosensitive drum 10. The recording sheet 40 on which the toner image is transferred is transported into the fixing unit (not shown), and the toner image is fixed on the recording sheet by the fixing unit. Residual toner and the like on the photosensitive drum 10 on which the toner image is transferred are removed by the cleaning unit 25.

The cleaning unit 25 includes in a housing **25*b* a blade 25*a* which comes into contact with the surface of the photosensitive drum 10. The starting end of the spiral conveyer 70 is disposed at the lower part the housing 25*b*, and the terminal end of the spiral conveyer 70 is disposed in the developing unit 23 as described above. The toner and the like removed from the surface of the photosensitive drum 10 are transported into the developing unit 23 by the spiral conveyer 70**.

In the image forming apparatus described above, when the toner image corresponding to the main image is formed on the surface of the photosensitive drum 10, the auxiliary image such as dates and marks is formed on the surface of the photosensitive drum 10 by the auxiliary image forming mechanism 30 disposed in the developing unit 23.

The toner and the like removed from the surface of the photosensitive drum 10 by the blade **25*a* of the cleaning unit 25 are transported into the developing unit 23 by the spiral conveyer 70. Then, the toner and the like are filtered by the mesh member 62 provided with vibration generated by the ultrasonic vibrator 37 and toner alone is efficiently supplied to the toner supply roller 38 in the auxiliary image forming mechanism 30. The toner is mixed with carrier in the developing unit 23, charged by friction, and supplied to the insulating substrate 31**.

The operation of the auxiliary image forming mechanism 30 is the same as that of the second example.

The toner images respectively corresponding to the main image and the auxiliary image are transferred onto the recording sheet 40 by the transfer unit 24. The recording sheet 40 on which the main image and the auxiliary image are transferred is transported into the fixing unit (not shown), and the respective images are fixed on the recording sheet 40 by the fixing unit. Residual toner and the like on the photosensitive drum 10 from which the toner image is transferred are removed by the cleaning unit 25. The toner and the like removed by the cleaning unit 25 is returned to the developing unit 23 by the spiral conveyer 70 and used in the auxiliary image forming mechanism 30.

EXAMPLE 4

Figure 6:
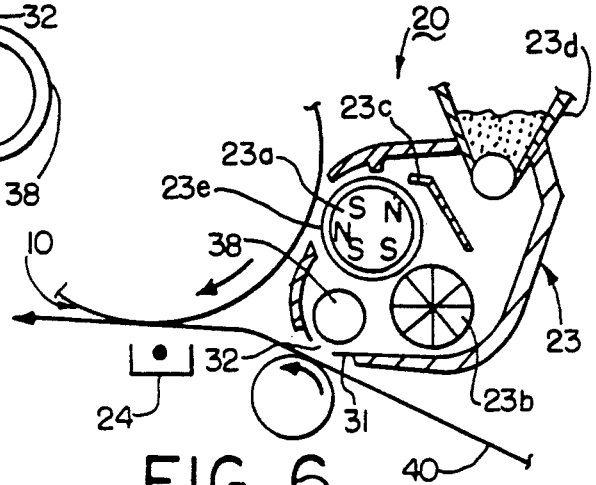
FIG. 6 is a schematic diagram showing a structure of the forth example of the image forming apparatus according to the present invention.

In the above examples, immediately after the static latent image formed on the photosensitive drum 10 is developed by the developing unit 23, the auxiliary image is formed on the photosensitive drum 10 by the auxiliary image forming mechanism 30. The auxiliary image can be formed not on the surface of the photosensitive drum 10 but directly on the recording sheet 40. This kind of image forming apparatus is shown in FIG. 6. In this image forming apparatus, the insulating substrate 31 provided with a plurality of toner passage holes 32 in the auxiliary image forming mechanism 30 is disposed facing the transportation path for a recording sheet at the lower portion of the developing unit 23. The respective toner passage holes 32 of the insulating substrate 31 are aligned in the direction orthogonal to that of the transportation of the recording sheet. The toner supply roller 38 for supplying the toner in the developing unit 23 to the insulating substrate 31 is disposed above the insulating substrate 31. The other structures of the auxiliary image forming mechanism 30 are the same as those of the second example. Therefore, its description is omitted here.

A base roller 50 as an opposing electrode is provided below the insulating substrate 31. The base roller 50 is grounded. The recording sheet 40 is transported between the signal electrodes 35 and the base roller 50 while being in contact with the base roller 50.

In the present example, toner is passed through the predetermined toner passage holes 32 by the auxiliary image forming mechanism 30 disposed in the developing unit 23 onto the recording sheet 40 on which the main image is not yet transferred. Then, the toner passed through the toner passage holes 32 is dropped onto the recording sheet 40 through an electric field between the grounded base roller 50 and the signal electrodes 35.

As described above, the main image formed on the photosensitive drum 10 is transferred by the transfer unit 24 onto the recording sheet 40 on which the auxiliary image is formed. The auxiliary image is formed on the recording sheet 40 together with the main image. These toner images are fixed by the fixing unit (not shown).

EXAMPLE 5

Figure 7:
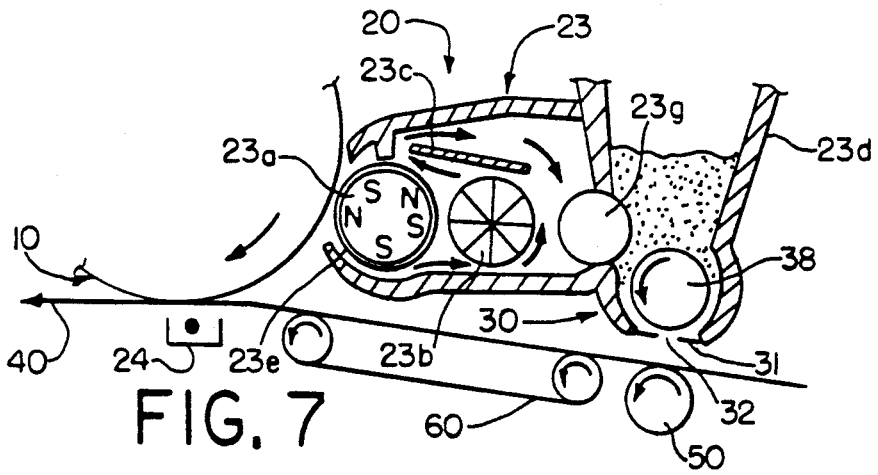
FIG. 7 is a schematic diagram showing a structure of the fifth example of the image forming apparatus according to the present invention.

The fifth example of the image forming apparatus of the present invention is shown in FIG. 7. In the image forming apparatus of the present example, the toner hopper **23*d* is disposed on the other side of the photosensitive drum 10 with respect to the developing unit 23, and the auxiliary image forming mechanism 30 is disposed below the toner hopper 23*d*. The insulating substrate 31 of the auxiliary image forming mechanism 30 is horizontally disposed at the undermost portion of the toner hopper 23*d* so as to face the transportation path for a recording sheet. The toner supply roller 38 is disposed above the insulating substrate 31. The base roller 50 is disposed below the insulating substrate 31. Toner in the toner hopper 23***d* is supplied to a chamber in which the developing sleeve 23*e* is accommodated by a toner supplement roller 23*g* provided on the upper side of the toner supply roller 38.

The other structures of the auxiliary image forming mechanism 30 are the same as those of the forth example. Therefore, its their description is omitted here.

A transportation belt 60 for transporting the recording sheet 40 on which the auxiliary image is formed is provided between the base roller 50 and the transfer unit 24.

In this example, the auxiliary image is formed on the recording sheet 40 on which the main image is not yet transferred.

In this example, the insulating substrate 31 is provided in the toner hopper 23*d* for accommodating supplement toner, so that the toner is efficiently supplied to the toner passage holes 32 of the insulating substrate 31.

EXAMPLE 6

Figure 8:
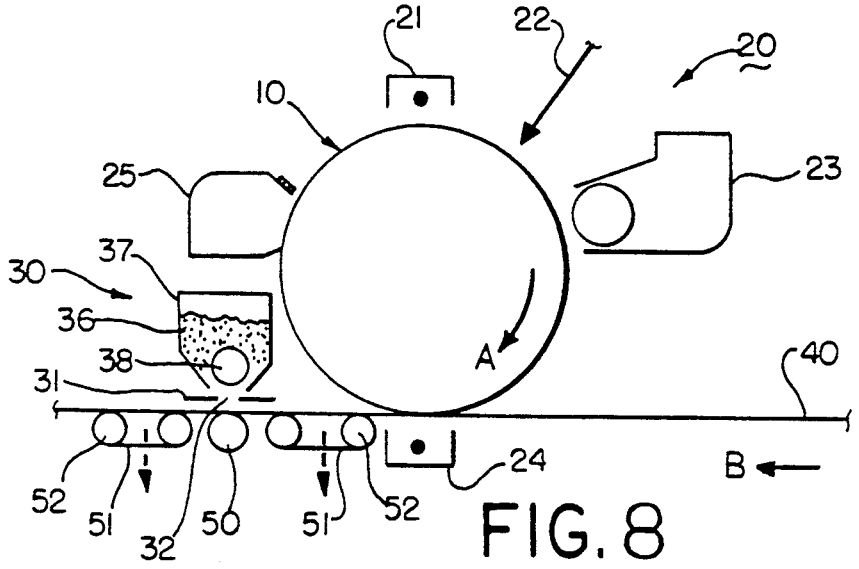
FIG. 8 is a schematic diagram showing a structure of the sixth example of the image forming apparatus according to the present invention.
Figure 9:
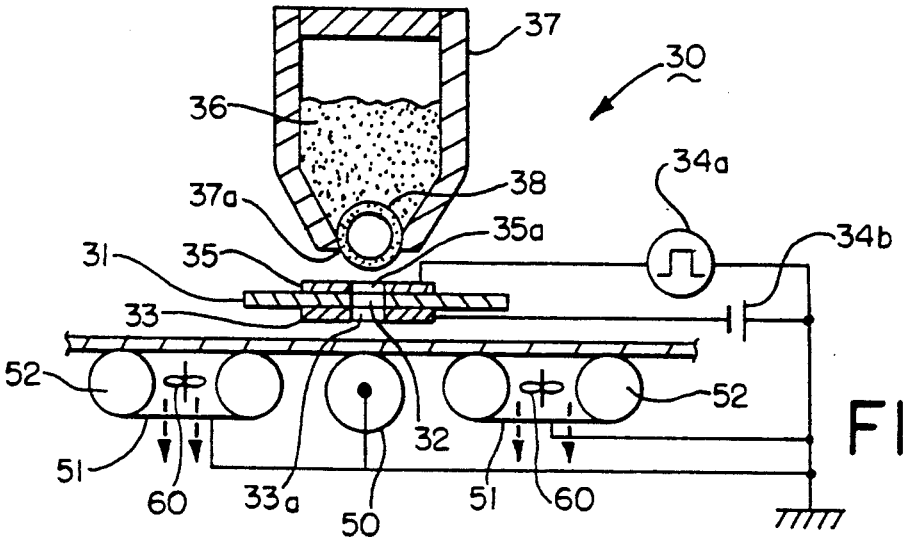
FIG. 9 is a diagram showing enlarged main portions of the image forming apparatus shown in FIG. 8.

The sixth example of the image forming apparatus of the present invention is shown in FIG. 8. In this image forming apparatus, the auxiliary image forming mechanism 30 is provided on the downstream side of the direction of transporting the recording sheet 40 of the transfer unit 24 disposed below the photosensitive drum 10. The insulating substrate 31 is provided in the auxiliary image forming mechanism 30 so as to face the portion, which is for forming the main image, of the recording sheet 40 on which the toner image corresponding to the main image formed on the photosensitive drum 10 is transferred. On the insulating substrate 31, the plurality of toner passage holes 32 are aligned in the direction orthogonal to that of transporting the recording sheet 40. As shown in FIG. 9, on the surface of the insulating substrate 31 facing the recording sheet 40, the common electrode 33 having the through holes 33*a* aligned with each toner passage hole 32 is disposed. On the other surface thereof, the plurality of signal electrodes 35 having the through holes 35*a* aligned with each toner passage hole 32 are disposed. The common electrode 33 is applied with a predetermined negative potential by the bias power source 34*b*. A predetermined negative potential is applied to each signal electrode 35 by the image information generating element 34*a* based on the image information. The toner container 37 is provided above each signal electrode 35, and negatively charged toner accommodated in the toner container 37 is supplied to each signal electrode 35 by the toner supply roller 38 provided at the lower portion of the toner container 37.

A base roller 50 is provided below the common electrode 33 of the insulating substrate 31 as an opposing electrode. The base roller 50 is grounded. The recording sheet 40 is transported between the common electrode 33 and the base roller 50 while being in contact with the base roller 50.

A pair of transporting belts 51 made of a metal mesh belt is provided at the respective sides of the base roller 50 and revolve in the direction of transporting the recording sheet 40. The pair of transporting belts 51 are wound around each pair of transporting rollers 52. Between each pair of transporting rollers 52, a fan 60 which is driven to rotate so that air flow is generated downward is provided. The recording sheet 40 transported onto the transporting belts 51 is sucked by the fans 60 to be transported in the direction of an arrow B.

In the image forming apparatus of this example, after the main image is adhered to the recording sheet 40, toner is passed through the predetermined toner passage holes 32 by the auxiliary image forming mechanism 30 provided on the downstream side of the transfer unit 24. The toner passed through the toner passage holes 32 is dropped onto the recording sheet 40 through an electric field between the grounded base roller 50 and the common electrode 33.

As described above, the auxiliary image is added to the main image on the recording sheet 40 by the auxiliary image forming apparatus 30. These toner images are fixed by the fixing unit (not shown).

EXAMPLE 7

Figure 10:
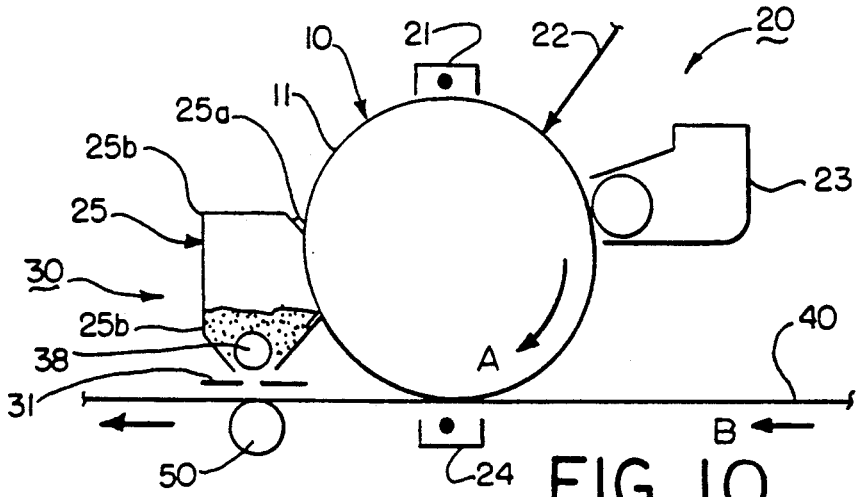
FIG. 10 is a schematic diagram showing a structure of the seventh example of the image forming apparatus according to the present invention.
Figure 11:
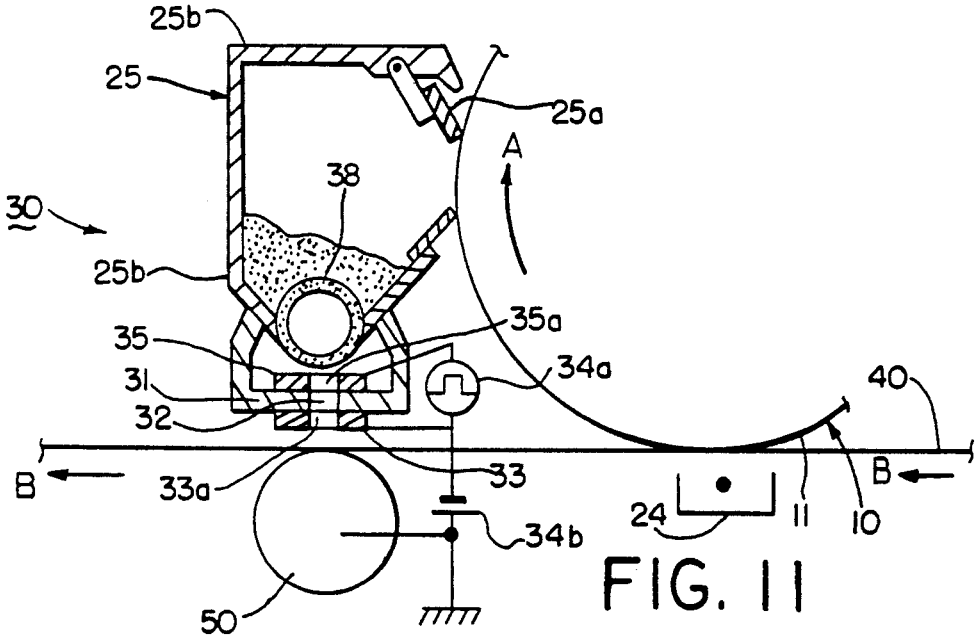
FIG. 11 is a diagram showing enlarged main portions of the image forming apparatus shown in FIG. 10.

The seventh example is shown in FIGS. 10 and 11. In this example, the auxiliary image forming mechanism 30 is provided in the cleaning unit 25 so that the auxiliary image is directly formed on the recording sheet 40 by the auxiliary image forming mechanism 30.

The auxiliary image forming mechanism 30 has the toner supply roller 38 provided at the lower portion of the housing 25*b* of the cleaning unit 25. In the housing 25*b*, toner removed from the photosensitive drum 10 is accommodated and a predetermined amount of toner is previously accommodated. The toner supply roller 38 is opposed to the recording sheet 40 transported with the main image transcribed thereon by the transfer unit 24.

The insulating substrate 31 is disposed between the toner supply roller 38 and the recording sheet 40. Each side of the insulating substrate 31 in the transporting direction of the recording sheet 40 is bent upwards and connected to the lower portion of the housing 25*b* as shown in FIG. 11. The plurality of toner passage holes 32 are aligned on the insulating substrate 31 in the direction orthogonal to the transporting direction of the recording sheet 40. On one surface of the insulating substrate 31 facing the recording sheet 40, the common electrode 33 having the through holes 33*a* respectively aligned with each toner passage hole 32 are provided. On the other surface, the plurality of signal electrodes 35 having the through holes 35*a* respectively aligned with each toner passage hole 32 are provided. The common electrode 33 is applied with negative potential by the bias power source 34*b*. Moreover, each signal electrode 35 is to be applied with a predetermined negative potential by the image information generating element 34*a* based on the image information. On each signal electrode 35, the housing 25*b* is provided, and the negatively charged toner accommodated in the housing 25*b* is supplied onto each signal electrode 35 by the toner supply roller 38 provided at the lower portion of the housing 25*b*.

The base roller 50 is provided below the common electrode 33 of the insulating substrate 31 as an opposing electrode. The base roller 50 is grounded. The recording sheet 40 is transported between the common electrode 33 and the base roller 50 while being in contact with the base roller 50.

In this image forming apparatus, after the toner image formed on the photosensitive drum 10 is transferred onto the recording sheet 40, the auxiliary image is formed on the recording sheet 40 by the auxiliary image forming mechanism 30.

As described above, the toner image corresponding to the auxiliary image is formed on the recording sheet 40 together with the toner image corresponding to the main image information. The recording sheet 40 on which the main image and the auxiliary image are formed is transported into the fixing unit (not shown), and the main image and the auxiliary image are fixed on the recording sheet 40 by the fixing unit.

EXAMPLE 8

Figure 12:
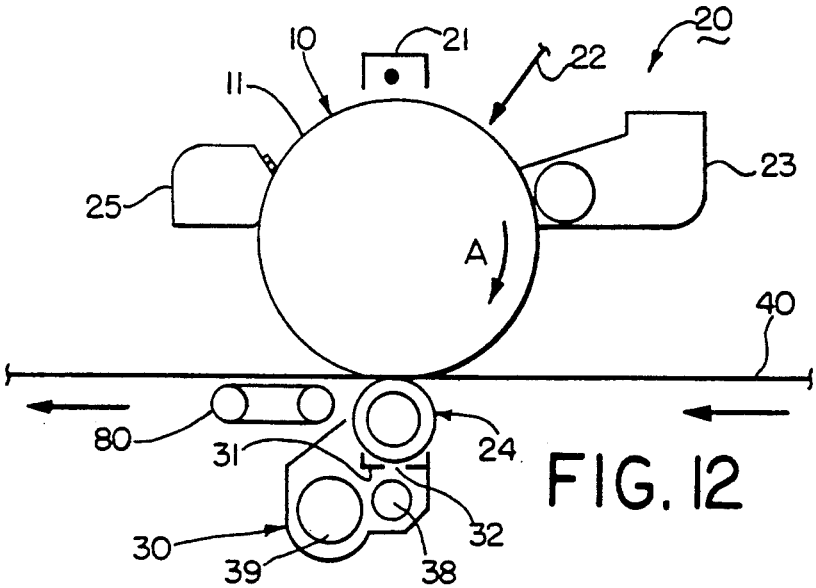
FIG. 12 is a schematic diagram showing a structure of the eighth example of the image forming apparatus according to the present invention.
Figure 13:
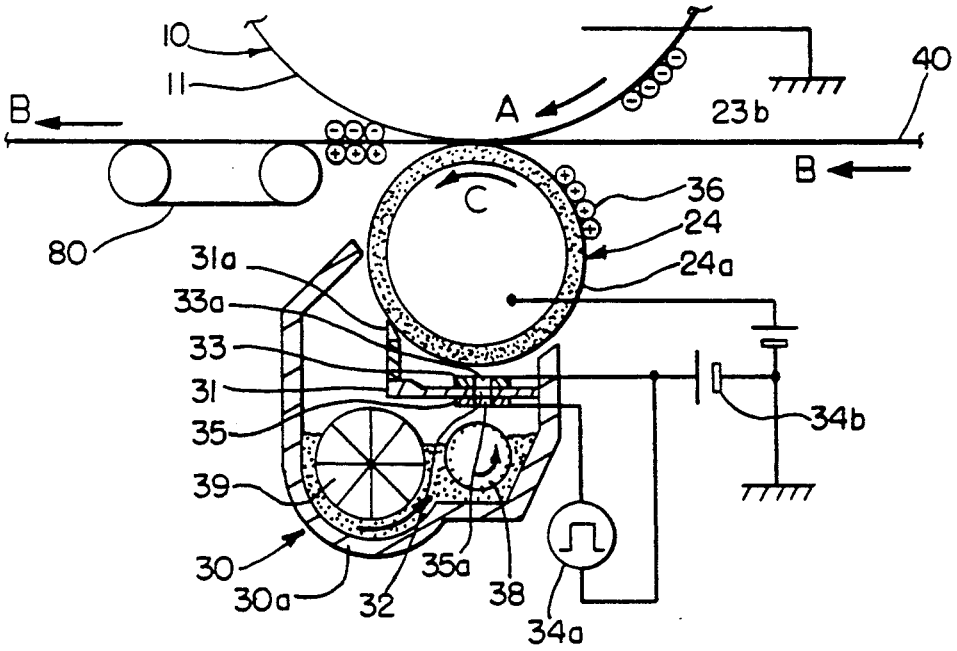
FIG. 13 is a diagram showing enlarged main portions of the image forming apparatus shown in FIG. 12.

The eighth example is shown in FIGS. 12 and 13. In this example, the auxiliary image and the main image are respectively formed on the opposite side surface of the recording sheet. The auxiliary image forming mechanism 30 is provided below a transfer roller 24 disposed below the photosensitive drum 10. The transfer roller 24 is rotated at the same peripheral speed as that of the photosensitive drum 10 in the direction of an arrow C so that the transfer roller 24 is pressed against the photosensitive drum 10 and the contact portion between the transfer roller 24 and the photosensitive drum 10 are moved in the same direction. The transfer roller 24 is applied, for example, with positive potential.

The auxiliary image forming mechanism 30 has the insulating substrate 31 disposed facing the transfer roller 24 therebelow. The insulating substrate 31 is generally horizontally fixed in the housing 30*a* formed so as to surround the lower portion of the transfer roller 24. In the housing 30*a*, toner for the auxiliary image which is to be positively charged is accommodated. A scraper 31*a* attached to the insulating substrate 31 is in contact with the upstream side of the rotation direction at the lower portion of the transfer roller 24 facing the insulating substrate 31, and unnecessary toner on the surface of the transfer roller 24 is removed by the scraper 31*a*.

On the insulating substrate 31, the plurality of toner passage holes 32 are aligned in the axial direction of the transfer roller 24. On the surface of the insulating substrate 31 facing the transfer roller 24, the common electrode 33 is provided. On the common electrode 33, the plurality of through holes 33*a* having the same size as that of each toner passage hole 32 are provided. Each through hole 33*a* is layered on the insulating substrate 31 so as to be respectively aligned with each toner passage hole 32. The common electrode 33 is applied by the bias power source 34*b* with a predetermined positive voltage which is higher than the positive voltage applied to the transfer roller 24.

The plurality of signal electrodes 35 having the through holes 35*a* similar to the toner passage holes 32 are provided on the lower surface of the insulating substrate 31 so as to correspond to each toner passage hole 32. Each signal electrode 35 surrounds each toner passage hole 32 of the insulating substrate 31, and the signal electrodes 35 and the toner passage holes 32 are aligned with each other. The respective signal electrodes 35 provided at each toner passage hole 32 adjacent to each other are not in contact with each other. Each signal electrode 35 is applied with a predetermined voltage based on the image information by the image information generating element 34*a*.

The toner supply roller 38 which is driven to rotate is provided below the insulating substrate 31. The toner in the housing 30*a* is supplied to the toner passage holes 32 of the insulating substrate 31 by the toner supply roller 38. Moreover, in the housing 30*a*, the transportation roller 39 for transporting the toner into the toner supply roller 38 is provided adjacent thereto.

On the downstream side in the transportation direction of the recording sheet 40 of the transfer roller 24, the transport belt 80 is provided. The recording sheet 40 on which the main image and the auxiliary image are formed is transported into the fixing unit (not shown) by the transport belt 80.

The operation of the image forming apparatus having a construction mentioned above will be described below.

In this image forming apparatus, the negatively charged toner image corresponding to the main image information is formed on the surface of the photosensitive drum 10 by the main image forming mechanism 20.

On the other hand, in the auxiliary image forming mechanism 30 provided further below the transfer roller 24 below the photosensitive drum 10, a higher voltage than that applied to the common electrode 33 is applied to the predetermined signal electrodes 35, corresponding to the auxiliary image such as dates and marks. Because of this, an electric field which allows the positive charged toner to pass through the predetermined toner passage holes 32 of the insulating substrate 31 is formed, and the positively charged toner accommodated in the housing 30*a* is passed through the toner passage holes 32. The positively charged toner passed through the toner passage holes 32 is moved into the surface of the transfer roller 24 through an electric field between the common electrode 33 and the transfer roller 24. Accordingly, the image corresponding to the auxiliary image is formed on the transfer roller 24 with the positively charged toner.

As described above, the image corresponding to the main image is formed on the photosensitive drum 10 with the negatively charged toner. Moreover, when the image corresponding to the auxiliary image is formed with the positively charged toner on the transfer roller 24, the recording sheet 40 is transported between the photosensitive drum 10 and the transfer roller 24, synchronized with the rotations of the photosensitive drum 10 and the transfer roller 24. Then, the recording sheet 40 is pressed by the photosensitive drum 10 and the transfer roller 24. When the negatively charged toner image on the photosensitive drum 10 comes into contact with the recording sheet 40, the toner on the photosensitive drum 10 is attracted by the transfer roller 24 applied with the positive potential, whereby the toner image is transferred onto the recording sheet 40. In the same way, when the positively charged toner on the transfer roller 24 comes into contact with the recording sheet 40, the toner is attracted by the photosensitive drum 10 which is grounded, whereby the toner image is transferred onto the recording sheet 40. Accordingly, the main image corresponding to the main image information is formed on the upper surface of the recording sheet 40 to be transported and the auxiliary image corresponding to the auxiliary image information is formed on the lower surface of the recording sheet 40.

The recording sheet 40 on which the main image and the auxiliary image are formed is transported into the fixing unit (not shown), and the main image and the auxiliary image are fixed onto the recording sheet 40 by the fixing unit.

Residual toner on the photosensitive drum 10 from which the toner image is transferred is removed by the cleaning unit 25. Residual toner on the transfer roller 24 from which the toner image is transferred is removed by the scraper 31*a* to be accommodated in the housing 30*a*. The toner accommodated in the housing 30*a* is reused for forming the auxiliary image.

It is understood that various other modifications will be apparent to and can be readily made by those skilled in the art without departing from the scope and spirit of this invention. Accordingly, it is not intended that the scope of the claims appended hereto be limited to description as set forth herein, but rather that the claims be construed as encompassing all the features of patentable novelty that reside in the present invention, including all features that would be treated as equivalents thereof by those skilled in the art to which this invention pertains.

What is claimed is:

1. An image forming apparatus including a main image forming mechanism for forming a main image on a recording sheet by transferring a toner image formed on a photosensitive body based on image information onto the recording sheet and an auxiliary image forming mechanism for forming an auxiliary image on the recording sheet, wherein the auxiliary image forming mechanism comprises:

an insulating substrate having a plurality of toner passage holes;

a pair of electrodes which have through holes corresponding to the toner passage holes and which are disposed sandwiching the insulating substrate so that each through hole is aligned with each toner passage hole;

toner supply means for supplying toner onto the electrode on one side; and image information generating means for applying predetermined potential between the pair of electrodes so that potential allowing the toner to pass through the toner passage holes in accordance with the image information is formed at least in the toner passage holes.

2. An image forming apparatus according to claim 1, wherein the auxiliary image forming mechanism forms the auxiliary image on the photosensitive body on which the toner image is formed by the main image forming mechanism.

3. An image forming apparatus according to claim 2, wherein the main image forming mechanism includes a developing unit for forming the toner image on the photosensitive image, and the auxiliary image forming mechanism is disposed adjacent to the developing unit.

4. An image forming apparatus according to claim 2, wherein the main image forming mechanism includes a developing unit for forming the toner image on the photosensitive body, and the auxiliary image forming mechanism is disposed in the developing unit.

5. An image forming apparatus according to claim 4, wherein the main image forming mechanism includes a cleaning unit for cleaning the photosensitive body after the toner image formed on the photosensitive body is transferred onto the recording sheet, and the toner removed from the photosensitive body by the cleaning unit is supplied to the auxiliary image forming mechanism.

6. An image forming apparatus according to claim 1, wherein the auxiliary image forming mechanism forms the auxiliary image on the recording sheet.

7. An image forming apparatus according to claim 6, wherein the auxiliary image forming mechanism is disposed facing the recording sheet transported into a position where the toner image formed on the photosensitive body is transferred.

8. An image forming apparatus according to claim 7, wherein the main image forming mechanism includes a developing unit for forming the toner image on the photosensitive body, and the auxilary image forming mechanism is disposed in the developing unit.

9. An image forming apparatus according to claim 7, wherein the main image forming mechanism includes a developing unit for forming the toner image on the photosensitive body, the developing unit includes a toner accomodation means in which the toner is accommodated, and the auxiliary image forming mechanism is disposed in the toner accomodation means.

10. An image forming apparatus according to claim 6, wherein the auxiliary image forming mechanism is disposed facing the recording sheet transported with the toner image formed on the photosensitive body transferred thereon.

11. An image forming apparatus according to claim 10, wherein the main image forming mechanism includes a cleaning unit for cleaning the photosensitive body after the toner image formed on the photosensitive body is transferred onto the recording sheet, and the auxiliary image forming mechanism is disposed in the cleaning unit.

12. An image forming apparatus according to claim 1, wherein the auxiliary image forming mechanism forms the auxiliary image on the surface of the recording sheet which is an opposite side of the surface on which the toner image formed on the photosensitive body is transferred.

13. An image forming apparatus according to claim 12, wherein the main image forming mechanism includes a transfer roller for transferring the toner image formed on the photosensitive body onto the recording sheet, and the auxiliary image forming mechanism forms the auxiliary image on the transfer roller.

* * * * *